United States Patent [19]

Knudsen

[11] Patent Number: 4,765,389

[45] Date of Patent: Aug. 23, 1988

[54] CORE SETTER

[75] Inventor: Soren E. Knudsen, Lynge, Denmark

[73] Assignee: Dansk Industri Syndikat A/S, Herlev, Denmark

[21] Appl. No.: 5,723

[22] Filed: Jan. 21, 1987

[30] Foreign Application Priority Data

Jan. 24, 1986 [DK] Denmark ..... 373/86

[51] Int. Cl.[4] ..... B22C 9/10

[52] U.S. Cl. ..... 164/340; 164/137

[58] Field of Search ..... 164/340, 137

[56] References Cited

U.S. PATENT DOCUMENTS

| | | | |
|---|---|---|---|
| 3,168,765 | 2/1965 | Bernhardt | 164/340 X |
| 3,424,229 | 1/1969 | Gunnergaard-Poulsen | 164/340 |
| 4,079,774 | 3/1978 | Gunnergaard et al. | 164/340 X |
| 4,590,982 | 5/1986 | Hunter | 164/340 X |

FOREIGN PATENT DOCUMENTS

| | | | |
|---|---|---|---|
| 665503 | 10/1965 | Belgium | 164/340 |
| 59-189058 | 10/1984 | Japan | 164/340 |
| 564091 | 10/1977 | U.S.S.R. | 164/340 |

*Primary Examiner*—Nicholas P. Godici
*Assistant Examiner*—J. Reed Batten, Jr.
*Attorney, Agent, or Firm*—Larson and Taylor

[57] ABSTRACT

A core setter for use in setting one or more cores in the mould impression in the rearmost of a number of mould parts placed face to face during conveyance towards a pouring line. The setter consists of an essentially L-shaped swingable arm (1), which is pivotally journalled around a vertical axis (2) and at its free end, opposite the pivot, is provided with a core-retaining device (10), designed to accept cores in a position outside the moulding system and to deliver these into the mould impressions by a translational movement of the core-retaining device in the direction of conveyance of the mould parts.

5 Claims, 2 Drawing Sheets

1

CORE SETTER

Figure 1:
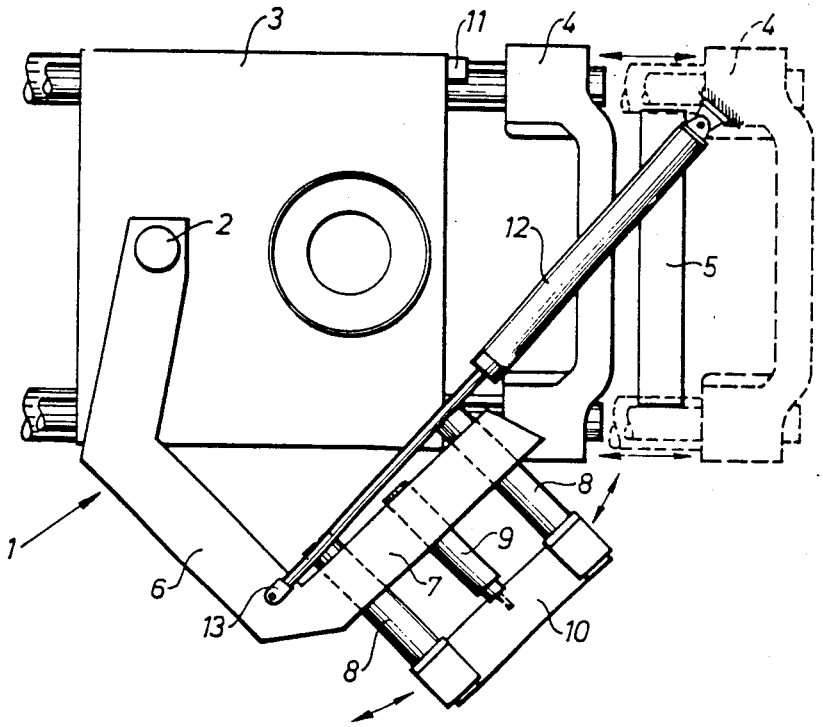

The invention relates to a core setter for use in placing one or more cores in the mould impression in the rearmost of a number of mould parts or in the mould impression on the front of the subsequent mould part during conveyance from the moulding chamber, such mould part having been made in a vertical moulding system and during conveyance towards a pouring line.

A wide range of assemblies and mechanisms are known which are designed for moving cores more or less automatically from a loading position outside the moulding plant behind the mould parts made, and from the said position transferring the cores from a retaining means to the mould impressions.

The known devices are in many cases constructed on a frame which is placed as an independent unit alongside the moulding system in a complex way and takes up much room. In addition, the known devices are as a rule designed with columnar guides placed at right angles to each other, whereby core setting is made along an L-shaped path. The two vertical columnar guides give "loose" steering with the consequent problems in relation to imprecise positioning of the cores in the mould impressions. Precision can be achieved by suitable dimensioning and working of the columnar guides used, but this is an expensive procedure.

The object of the invention is to provide a simplified core-setting mechanism, which takes up very little room, and which—by its simplicity of structure—provides great precision in positioning the core retainer in relation to the mould impressions.

According to the invention, this is achieved by a core setter of the type described in the opening paragraph, characterized by the setter comprising an essentially L-shaped swingable arm, at its one end pivotably journalled around a vertical axis, and at its other end designed to accept a core-retaining means, whereby the swingable arm can be swung between a core-releasing position, in which the core-retaining means is placed behind the rearmost mould part and in line with it, and a loading position outside the line of mould parts, and that means are provided to convey the core-retaining means translationally towards and away from the mould impression in the releasing position.

The L-shaped swingable arm ensures a very high rigidity in the moving mechanism, as the one bearing point and the swingable arm form a rigid structure without linear columnar guides, as is otherwise known from the L-guides referred to above. Any play can be limited to that part of the movement where the core-retaining means is conveyed translationally forwards on bearing guides towards the mould impression.

In a possible embodiment of a core setter according to the invention, the swingable arm is pivotably journalled around a pivot secured on the moulding chamber, and the means for providing the translational movement of the core-retaining means is a cylinder piston unit inserted between the swingable arm and the core-retaining means, said core-retaining means being suspended on the swingable arm and guided in at least two bearing guides.

Thus, accurate and easily controllable movement of the core-retaining means during core delivery is obtained by simple means.

In another embodiment, the swingable arm can be pivotally journalled around a pivot on a slide placed slideably on the moulding chamber structure, whereby the translational movement of the core-retaining means is provided by reciprocating the slide in the longitudinal direction of the moulding chamber. This conveying of the swingable arm by the slide outside the chamber permits a quicker working sequence, as the dimensions of the core-retaining means can be minimized, whereby the inertia force of the arm is reduced to a minimum.

By placing the vertical pivot axis of the swingable arm, as proposed according to the invention, in the vertical symmetrical plane of the moulding chamber, a lead-in path is achieved with the flattest possible lead-in sequence, and thus the opportunity to operate with the largest possible core height at given dimensions, in particular the distance between the moulding chamber and the rearmost mould part.

According to the invention, a stop means may be mounted on the moulding chamber structure to limit the pivotal movement of the swingable arm and to control it during the translational feeding of the core-retaining means.

This ensures even greater precision during the translational portion of the movement of the core-retaining means, and in particular great precision in the core delivery moment.

According to the invention, the L-shaped swingable arm can be cranked with a shape corresponding to fixed obstructions on the moulding chamber structure.

This embodiment structure makes it possible to use a swingable arm structure, where the outermost portions of the swingable arm are removed as little as possible from the sides of the moulding chamber in the loading position. At the same time, a placement possibility for the pivot point of the swingable arm is achieved, which is independent of the remaining components of the moulding plant.

The embodiments described above provide the common additional advantage in that the core-retaining means may be swung entirely away from the lead-in area, if cores are not to be used, or if the loading operation takes place more expediently at a greater distance from the machine.

A further significant feature of the invention is that the core setter may be swung into the core-releasing position for shipping purposes, so that the machine will arrive readymounted to the user. In known systems, the core setter unit has to be packed and shipped separately and the unit must be mounted in situ, which often gives rise to practical problems, and in all circumstances adds to costs.

Figure 2:
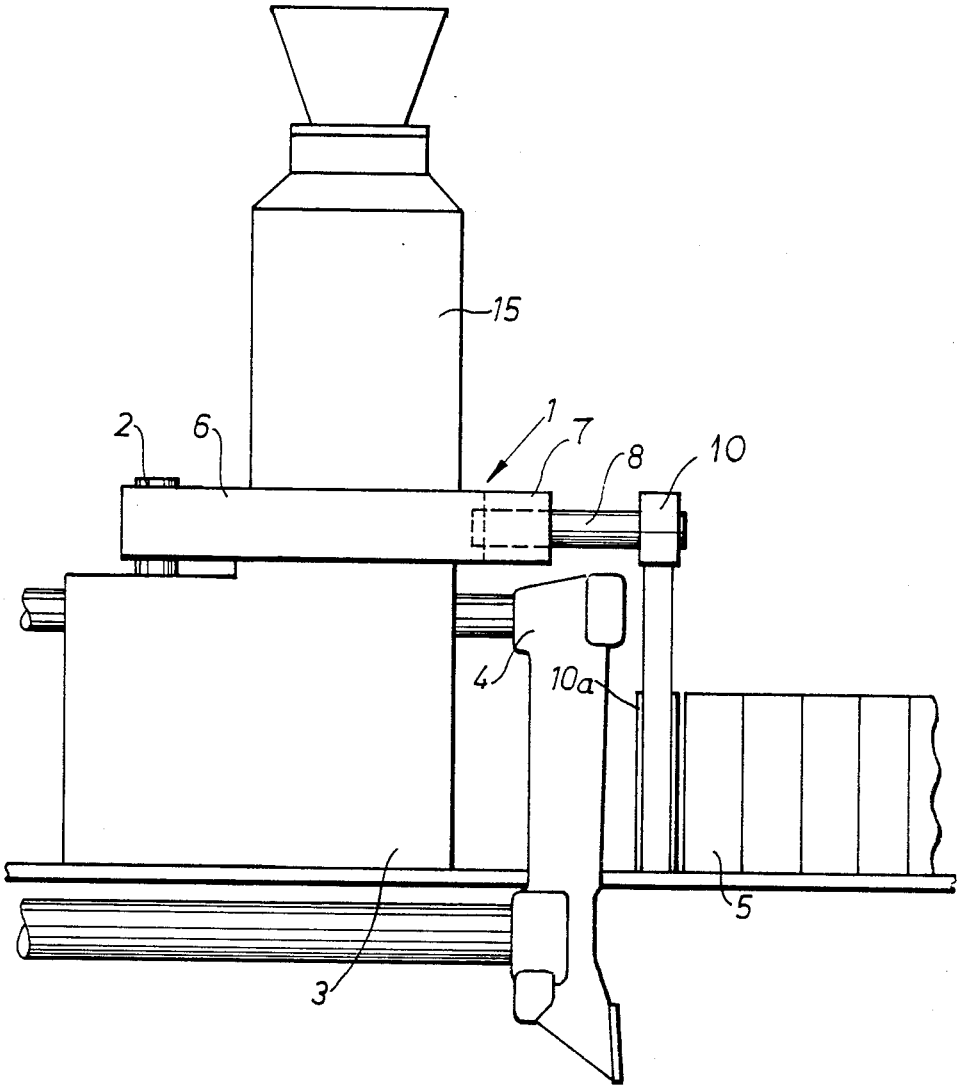

Below, the invention will be explained in detail with reference to the drawing, in which FIG. 1 is a schematic view of a core setter according to the invention, seen from above, and FIG. 2 is the same in a schematic vertical section.

In FIG. 1, the swingable arm is generally shown by the reference number 1. The L-shaped swingable arm 1 is pivotally journalled around a vertical axis 2 above the moulding chamber 3 in a machine (not shown in more detail) for making mould parts of sand or other like mouldable material.

In front of the moulding chamber 3 there is a foremost yoke 4, which, as indicated in dashed lines, can be reciprocated lengthwise in the moulding chamber between a position (solid lines), in which the swingable plate, pivotally suspended from the yoke, forms a mould limitation face in the moulding chamber, and a position (dashed lines), in which the yoke is free from the moulding chamber, and the swingable plate has been swung up, so that the mould parts 5 made in the moulding chamber 3 can be shot out of the latter.

The swingable arm 1 consists of two sections, 6 and 7, of which the former is designed to pivot around the pivot 2 and support the second section 7 in such a way that the latter is swung in between the rearmost mould part 5 and the moulding chamber 3 in front of the said yoke 4 in its squeeze position by pivoting around the pivot 2.

In the shown embodiment, the part 7 supports two columns 8, on which a core mask 10 is provided for reciprocating by actuation of a cylinder piston unit 9.

When the swingable arm 1 has thus been swung in behind the mould part 5, the cores 10*a* in the core mask 10 can be fed into the mould impression in the mould part 5 in a manner known per se.

The movement of the swingable arm is controlled by the cylinder piston unit 12, which connects with the swingable arm via a link connection 13. In the swung-in position, the swingable arm is fixed by abutting one or more stops 11.

It should be noted that the core mask 10 can be designed so as to move against the direction of travel of the mould parts, whereby the cores are placed in the last mould part in process of being transported away from the moulding chamber.

In FIG. 2, the swingable arm 1 is seen from the side in its swung-in position behind the mould part 5.

In FIG. 2, the parts corresponding to those shown in FIG. 1, are designated by the same reference numbers.

A sand container 15 is conventionally placed above the moulding chamber 3; from this container the moulding said is shot into the moulding chamber 3.

The invention is not limited to precisely the depicted and described features, and hence it will be possible to make use of a slide mounted on the moulding chamber structure, which supports the pivot 2, and in such a way that the translational movement of the core mask 10 is provided by reciprocating the slide in relation to the chamber structure.

I claim:

1. In combination, a moulding chamber and a core setter for use in placing one or more cores in a mould impression in the rearmost of a plurality of mould parts in line or in a mould impression on the front of a mould part during conveyance thereof from the moulding chamber, such mould part having been made in a vertical moulding system and during conveyance towards a pouring line, said core setter comprising an essentially L-shaped swingable arm, pivotally journalled at one end thereof around a vertical axis disposed in or aligned with a vertical plane within the moulding chamber and including means at the other end thereof for accepting a core-retaining means whereby the swingable arm can be swung between a core-releasing position, in which the core-retaining means is placed behind the rearmost mould part and in line therewith, and a core-loading position outside the line of mould parts, and said combination further comprising means for providing translational movement of the core-retaining means towards and away from the mould impression in the core-releasing position of the swingable arm.

2. The combination according to claim 1, characterized in that the swingable arm is pivotally journalled around a pivot secured to the moulding chamber, and that the means for providing the translational movement of the core-retaining means is a cylinder piston unit inserted between the swingable arm and the core-retaining means, said the core-retaining means being suspended on the swingable arm and guided in at least two bearing guides.

3. The combination according to claim 2, characterized in that the vertical pivot axis of the swingable arm is disposed in a vertical symmetrical plane through the moulding chamber.

4. The combination according to claim 1, characterized in that a stop means is mounted on the moulding chamber to limit the pivotal movement of the swingable arm and to control the swingable arm during the translational movement of the core-retaining means.

5. The combination according to claim 1, characterized in that the L-shaped swingable arm is cranked so as to have a shape corresponding to fixed obstructions on the moulding chamber.

* * * * *